US007362071B2

(12) United States Patent
Morinaga et al.

(10) Patent No.: US 7,362,071 B2
(45) Date of Patent: Apr. 22, 2008

(54) ROTATION CONTROL DEVICE, ROTATION CONTROL METHOD AND CONSTRUCTION MACHINE

(75) Inventors: Jun Morinaga, Yokohama (JP); Tadashi Kawaguchi, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 11/596,208

(22) PCT Filed: May 13, 2005

(86) PCT No.: PCT/JP2005/008755

§ 371 (c)(1),
(2), (4) Date: Nov. 13, 2006

(87) PCT Pub. No.: WO2005/111321

PCT Pub. Date: Nov. 24, 2005

(65) Prior Publication Data

US 2007/0216331 A1 Sep. 20, 2007

(30) Foreign Application Priority Data

May 13, 2004 (JP) ..... 2004-143533

(51) Int. Cl.
*G05B 1/00* (2006.01)

(52) U.S. Cl. ..... 318/652; 318/638; 318/639; 318/799; 318/461; 318/798; 318/823

(58) Field of Classification Search ..... 318/638, 318/639, 652, 452; 700/90
See application file for complete search history.

(56) References Cited

U.S. PATENT DOCUMENTS 5,835,874 A * 11/1998 Hirata et al. ..... 701/50
2005/0253542 A1* 11/2005 Sugano et al. ..... 318/371
2006/0099081 A1* 5/2006 Toda et al. ..... 417/1

FOREIGN PATENT DOCUMENTS

JP 11-269937 A 10/1999
JP 2001-11897 A 1/2001
JP 2003-328398 A 11/2003
JP 2004-36303 A 2/2004

* cited by examiner

*Primary Examiner*—Rita Leykin
(74) *Attorney, Agent, or Firm*—Frishauf, Holtz, Goodman & Chick, P.C.

(57) ABSTRACT

In an electric rotary excavator (construction machine) 1, when earth pressure acts on a rotary body 4 in an opposite direction to an instructed direction of a lever, a control-system changing means 150 of a rotation control device 100 increases a torque output of an electric motor 5 that drives the rotary body 4. Accordingly, the torque output can properly react against the acting earth pressure, thereby preventing the rotary body from continuing to be rotated in the opposite direction. Therefore, even when the earth pressure becomes large, the work will not be affected. In addition, when the rotary body is rotated on a slope, the rotary body can be prevented from being rotated back greatly due to the weights of the boom and the arm.

11 Claims, 16 Drawing Sheets

ROTATION CONTROL DEVICE, ROTATION CONTROL METHOD AND CONSTRUCTION MACHINE

This application is a U.S. National Phase Application under 35 USC 371 of International Application PCT/JP2005/008755 filed May 13, 2005.

TECHNICAL FIELD

The present invention relates to a rotation control device and a rotation control method for controlling a rotary body that is rotated by an electric motor and a construction machine in which the rotary body is rotated by the electric motor.

BACKGROUND ART

Recently, hybrid electric rotary excavators have been being developed, in which a rotary body is driven by an electric motor and other members such as a work machine and a carrier are driven by a hydraulic actuator (see, for instance, Patent Document 1).

Since the rotation of the rotary body is driven by the electric motor in such electric rotary excavators, even when the rotary body is rotated while a boom and an arm that are driven hydraulically are lifted up, the rotation of the rotary body is not affected by the lifting of the boom and the arm. Accordingly, an energy loss at a control valve or the like can be reduced as compared to an arrangement in which the rotary body is also driven hydraulically, thereby enhancing energy efficiency.

[Patent Document 1] JP-A-2001-11897

DISCLOSURE OF THE INVENTION

Problems to be Solved by the Invention

Meanwhile, when excavation for widening the width of a groove or the like is performed by construction machines such as the electric rotary excavator, a bucket is usually pressed against a side wall of the groove. In order to press the bucket against the side wall, a rotation lever is tilted in a predetermined direction to rotate the rotary body. In other words, the bucket is pressed against the side wall using a torque output generated in rotating the rotary body.

However, the bucket might be pushed back by earth pressure (excavation reaction force) during the excavation depending on a condition of a ground, i.e., hardness and profile of a part to be excavated of the ground, which causes a phenomenon where, even though the rotation lever is operated in the predetermined direction, the rotary body rotates in a direction opposite to an operated rotation direction. Such phenomenon makes it difficult for an operator to perform one's desired work, which might lower working efficiency.

Such phenomenon might occur when the rotary body is rotated on an inclined ground in addition to when the excavation is performed. For example, when the bucket is tried to be moved toward an upper side in an inclination direction by rotating the rotary body, the boom and the arm are also moved against the gravitational force, which causes the rotary body to temporarily rotate in an opposite direction due to the weights of the boom and the arm.

An object of the present invention is to provide a rotation control device, a rotation control method and a construction machine which can prevent a rotary body, even when an external force acts on the rotary body in an opposite direction to an operated rotation direction, from rotating in the opposite direction.

Means for Solving the Problems

A rotation control device according to an aspect of the present invention that controls rotation of a rotary body driven by an electric motor based on a command from an operating section, includes: a rotation position output means which outputs rotation position information of the rotary body; a reference position storage means which stores an output value of the rotation position output means as a reference position; a control command generating means which generates and outputs a control command for the electric motor; a control-system change judging means which judges whether or not to change a control system of the rotation control device based on the output value of the rotation position output means, the reference position stored in the reference position storage means and an operated direction of the operating section; and a control-system changing means which changes the control system of the rotation control device in accordance with the judgment result of the control-system change judging means, in which the control-system change judging means changes the control system so as to increase the control command for the electric motor to be a larger value than that before the change of the control system.

According to the aspect of the present invention, the control-system changing means changes the control system of the rotation control device so as to change the control command for the electric motor to be larger than the value before the change of the control system. Accordingly, the rotary body properly reacts against acting external force, thereby preventing the rotary body from keeping rotating in the opposite direction.

In the rotation control device according to the aspect of the present invention, it is preferable that the control system changing means includes: a reference position update section which updates the reference position stored in the reference position storage means in accordance with the judgment result of the control-system change judging means; a change command generator which generates a change command for the electric motor based on the output value of the rotation position output means and the reference position stored in the reference position storage means; and a control command output section which selects one with a larger value out of the control command by the control command generating means and the change command by the change command generator and outputting the selected one with the larger value as a control command for the electric motor. The change of the control system is to maintain the reference position.

According to the aspect of the present invention, the control command output section of the control-system changing means selects the one with the larger value out of the control command by the control command generating means and the change command by change command generator and outputs the larger one as the control command for the electric motor. With the arrangement, a situation where the control command for the electric motor is changed rapidly and suddenly by the change of the control system can be avoided, thereby realizing smooth control and achieving the object of the present invention.

In the rotation control device according to the aspect of the present invention, it is preferable that the control system changing means includes: a reference position update section which updates the reference position stored in the reference position storage means in accordance with the judgment result of the control-system change judging means; a switch-control command generator which generates and outputs a control command for the electric motor using a control law different from that of the control command generating means; and a control law switch section which switches a control law between the control command generating means and the switch-control command generator in accordance with the judgment result of the control-system change judging means. The change of the control system is to switch the control law from the control command generating means to the switch-control command generator with the control law switch section.

According to the aspect of the present invention, the control law switch section of the control-system changing means does not amplify the speed gain, but switches the control law from the control command generating means to the switch-control command generator, an excessive torque output will not be generated during normal rotation.

In the rotation control device according to the aspect of the present invention, it is preferable that the control system changing means includes: a reference position update section which updates the reference position stored in the reference position storage means in accordance with the judgment result of the control-system change judging means; a control gain storage which stores a plurality of control gains for the rotary body; and a control gain changer which changes a control gain to be selected from the control gain storage in accordance with the judgment result of the control-system change judging means. The change of the control system is to change the control gain with the control gain changer.

According to the aspect of the present invention, the control gain changer of the control-system changing means can change the control gain based on the judgment result of the control-system change judging means, the change of the control gain preventing the rotary body from rotating in the opposite direction.

In the rotation control device according to the aspect of the present invention, it is preferable that the control system changing means includes: a reference position update section which updates the reference position stored in the reference position storage means in accordance with the judgment result of the control-system change judging means; and a target value changer which changes a control target value of the rotary body which has been set based on an operation input at the operating section in accordance with the output value of the rotation position output means and the reference position stored in the reference position storage means. The change of the control system is to change the target value with the target value changer.

According to the aspect of the present invention, the target value changer of the control-system changing means can change the control target value of the rotary body, the change of the control target value preventing the rotary body from rotating in the opposite direction.

A rotation control method according to another aspect of the present invention for controlling rotation of a rotary body driven by an electric motor based on a command from an operating section includes: outputting rotation position information of the rotary body; storing an output value of the output rotation position information as a reference position; generating and outputting a control command for the electric motor; judging whether or not to change a control system of a rotation control device based on the output value of the rotation position information, the stored reference position and an operated direction of the operating section; and increasing, when judging to change the control system of the rotation control device, the control command for the electric motor to be a value larger than that before the change of the control system.

According to the aspect of the present invention, when it is determined that the control system of the rotation control device is to be changed in the step for judging whether or not to change the control system of the rotation control device, the control command for the electric motor is changed to be larger than the value before the change of the control system. Accordingly, the rotary body properly reacts against the acting external force, thereby preventing the rotary body from keeping rotating in the opposite direction.

A construction machine according to still another aspect of the present invention includes: a rotary body that is rotated by an electric motor; and the above-described rotation control device of the present invention, the rotation control device controlling the rotary body.

According to the aspect of the present invention, the construction machine includes: the rotary body that is rotated by the electric motor; and the rotation control device of the present invention which controls the rotary body, the construction machine having advantages the same as those of the rotation control device of the present invention can be provided.

EXPLANATION OF CODES

Figure 1:
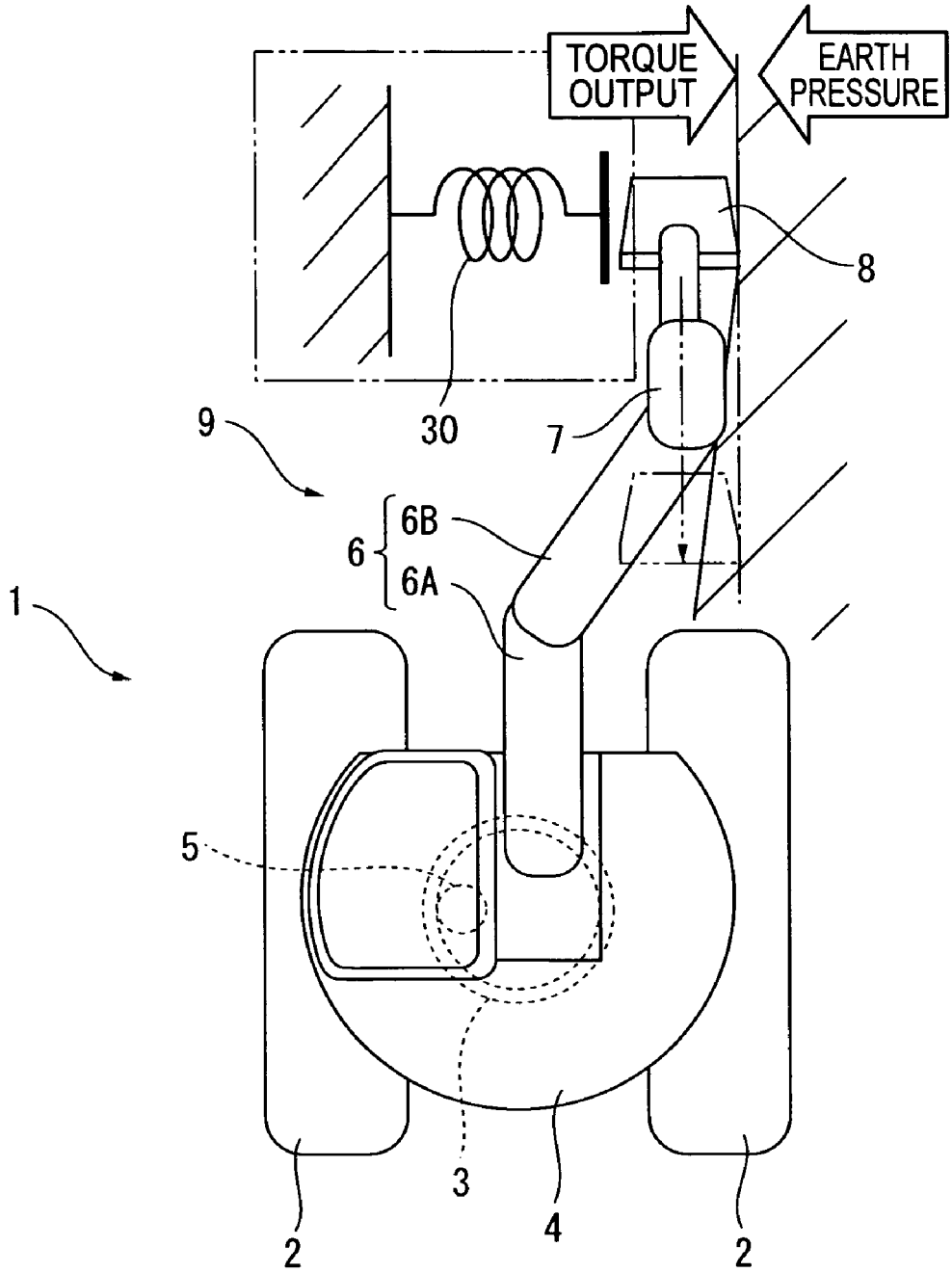
FIG. 1 is a plan view schematically showing a construction machine according to a first embodiment of the present invention.

1: electric rotary excavator (construction machine)
4: rotary body
5: electric motor
10: rotation lever (operating section)
41: restricting device
100: rotation control device
110: rotation position output means
120: reference position storage means
130: control command generating means
140: control-system change judging means
150: control system changing means
150A, 151A, 152A, 153A: reference position update section
150B: change command generator
150C: comparator (control command output section)
151B: switch-control command generator
151C: control law switch
152B: control gain storage
152C: control gain changer
153B: target value changer
51: restricting device

BEST MODE FOR CARRYING OUT THE INVENTION

First Embodiment

[1-1] Overall Arrangement

A first embodiment of the present invention will be described below with reference to the attached drawings.

Figure 2:
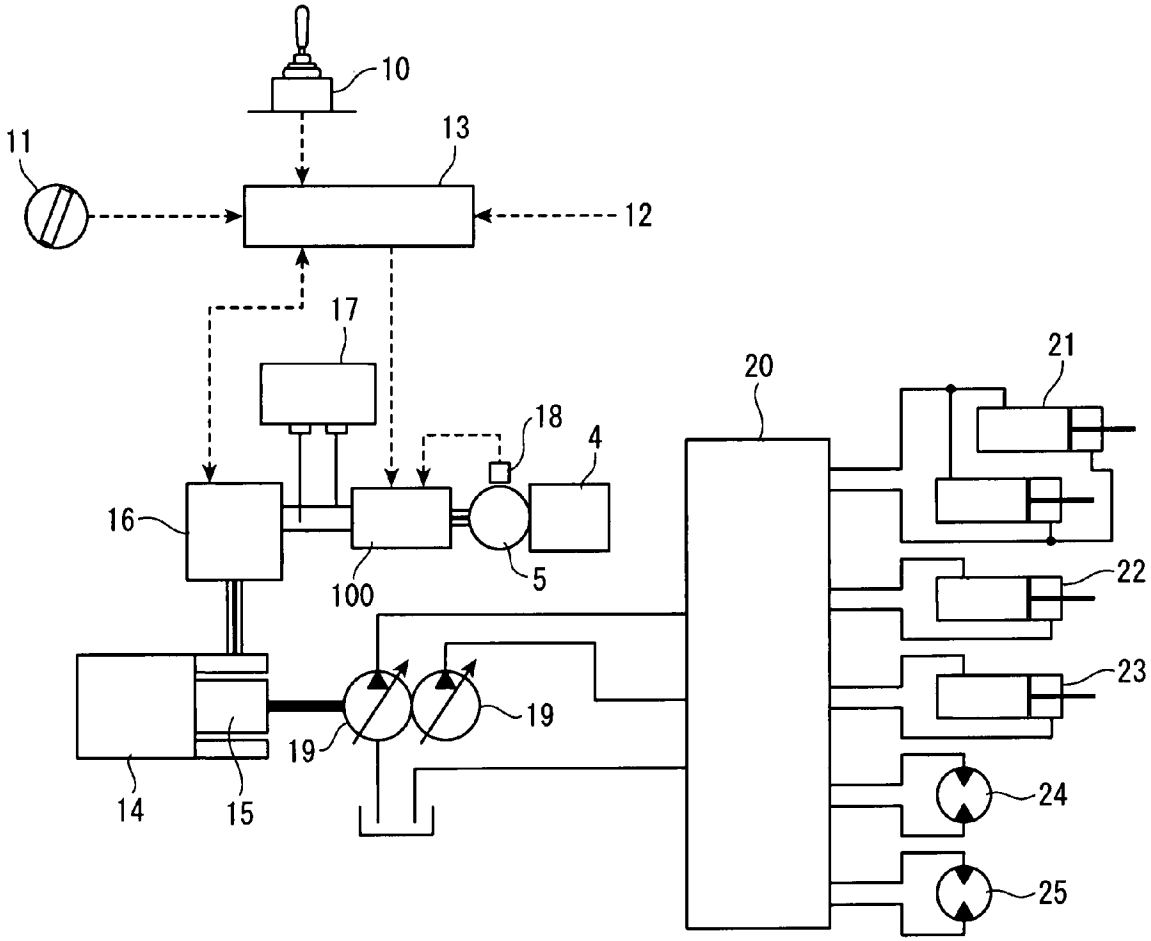
FIG. 2 is an illustration showing an overall arrangement of the construction machine according to the first embodiment.
Figure 3:
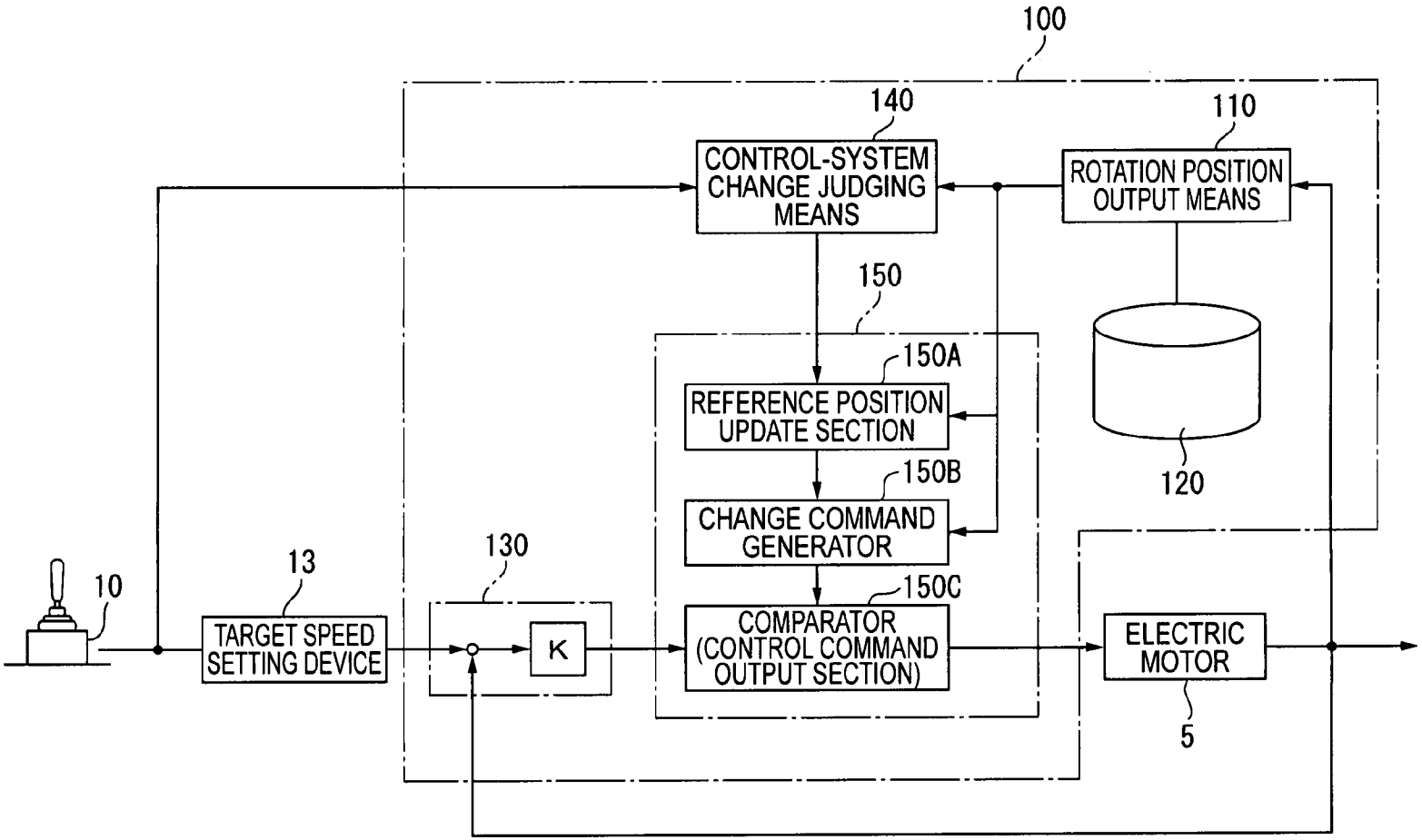
FIG. 3 is a block diagram showing a control structure of a rotation control device according to the first embodiment.

FIG. 1 is a plan view schematically showing an electric rotary excavator (construction machine) 1 according to the present embodiment. FIG. 2 is an illustration showing an overall arrangement of the electric rotary excavator 1. FIG. 3 is a block diagram showing a control structure of a rotation control device 100.

In FIG. 1, the electric rotary excavator 1 includes a rotary body 4 that is mounted on a track frame of a base carrier 2 via a swing circle 3, the rotary body 4 rotated by an electric motor 5 that is engaged with the swing circle 3. Attached to the rotary body 4 are a boom 6 driven by a boom cylinder 21 (see FIG. 2), an arm 7 driven by an arm cylinder 22 (see FIG. 2) and a bucket 8 driven by a bucket cylinder 23 (see FIG. 2), all of which consist a work machine 9.

In FIG. 2, each of the above-described cylinders 21 to 23 is a hydraulic cylinder, and a hydraulic power source thereof is a hydraulic pump 19 driven by a later-described engine 14. Accordingly, the electric rotary excavator 1 is a hybrid construction machine having the hydraulically-driven work machine 9 and the electrically-driven rotary body 4.

Incidentally, although the boom 6 of the present embodiment is a so-called offset boom that includes a first boom 6A and a second boom 6B, the boom 6 may include only one boom.

As shown in FIG. 2, the electric rotary excavator 1 includes, in addition to the above-described components, a rotation lever (operating section) 10, a fuel dial 11, a mode selection switch 12, a target speed setting device 13, an engine 14, a power-generating motor 15, an inverter 16, a capacitor 17, the electric motor 5, a rotation speed sensor 18, a hydraulic control valve 20, a right travel motor 24, a left travel motor 25 and the rotation control device 100.

The fuel dial 11 is a dial for controlling an amount of fuel supplied (injected) to the engine, and the mode selection switch 12 is a switch for switching a work mode among various work modes. The fuel dial 11 and the mode selection switch 12 are operated by an operator in accordance with an operation status of the electric rotary excavator 1.

The target speed setting device 13 sets a target speed of the rotary body 4 based on setting conditions of the fuel dial 11 and the mode selection switch 12 and a tilt angle of the rotation lever 10 (typically serving also as a work machine lever for operating the arm 7), the fuel dial 11 then outputting the target speed to the rotation control device 100.

The engine 14 drives the hydraulic pump 19 as the hydraulic power source for the hydraulic cylinders 21 to 23 and also drives the power-generating motor 15. Using hydraulic pressure generated by the hydraulic pump 19, the boom cylinder 21 drives the boom 6 (see FIG. 1), the arm cylinder 22 drives the arm 7 (see FIG. 1) and the bucket cylinder 23 drives the bucket 8 (see FIG. 1). The right travel motor 24 and the left travel motor 25 are hydraulic motors, and the hydraulic pump 19 also serves as the hydraulic power source for the hydraulic motors.

The power-generating motor 15, the inverter 16 and the capacitor 17 are used in combination as an electrical power source of the electric motor 5. Incidentally, the power-generating motor 15 can also serve as a generator that also has a function of the electrical motor.

The electric motor 5 rotates the rotary body 4 via the swing circle 3. The electric motor 5 is provided with the rotation speed sensor 18. The rotation speed sensor 18 senses a rotation speed of the electric motor 5, the sensed rotation speed being fed back to the rotation control device 100.

The rotation control device 100 performs speed control by a P control (proportional control) using a speed gain K (control gain) based on a target speed of the rotary body 4 which is set by the target speed setting device 13 and a rotation speed of the electric motor 5 which is sensed by the rotation speed sensor 18 in order to generate a torque command value as a control command for the electric motor 5. In the present embodiment, the rotation control device 100 that is constituted as an inverter inverts the torque command value to a current value and a voltage value and outputs the current and voltage values to the electric motor 5, thereby controlling a torque output of the electric motor 5.

Incidentally, the rotation control device 100 is not limited to the inverter but may be any device as long as the device can provide command for driving the electric motor by switching or the like.

In FIG. 1, the electric rotary excavator 1 performs excavation of a groove. Specifically, during the excavation, the electric rotary excavator 1 widens the width of the groove by pressing the bucket 8 against a side wall of the groove and drawing the arm toward a near side of the electric rotary excavator 1. The operation for pressing the bucket 8 against the side wall is so performed that, as shown in FIG. 1, the rotation lever 10 is tilted down rightward to rotate the rotary body 4 rightward, thereby pressing the bucket 8 against the side wall.

Figure 6:
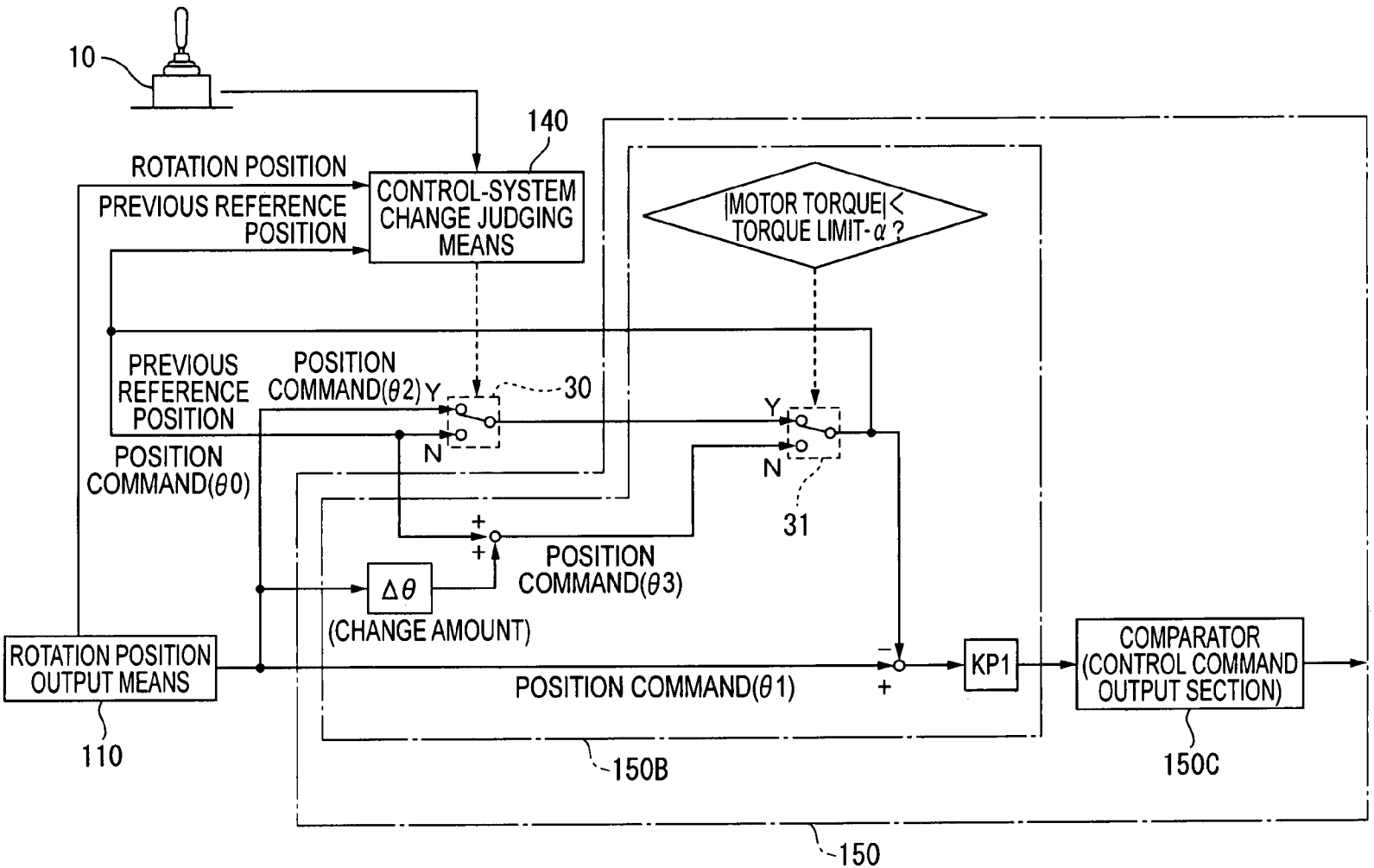
FIG. 6 is a detailed illustration showing a control according to the first embodiment.

Herein, when the electric rotary excavator 1 of the present embodiment rotates the rotary body 4 at a low speed to press the bucket 8 against the side wall, the electric rotary excavator 1 receives an earth pressure (i.e., excavation reaction or external force) from the side wall, and an actual speed becomes "0 (zero)". In other words, although the rotation lever 10 is tilted down, the rotary body 4 is not rotated. In this state, when the actual speed becomes "0", deviation from the target speed becomes large. In a typical speed control as described earlier, a torque command value is generated such that the torque output increases in accordance with the deviation to react against the earth pressure. However, since a limitation is set for the torque output, the torque output is allowed to be increased up to a torque limit-α (FIG. 6).

Meanwhile, even when the largest torque output for each condition is generated based on the typical speed control, there might be a situation where the largest torque output is not sufficient to react against the earth pressure. In an example shown in FIG. 1, such situation occurs when the bucket 8 hits a rock or the like while the excavation is performed with the bucket 8 pressed against the side wall and it becomes difficult to perform the excavation. In such case, the rotary body 4 yields to the earth pressure and is pushed back in the leftward rotation side even though the rotation lever 10 is tilted down to the rightward rotation side. When a change amount at the time of the pushing-back is large, the work might be impeded.

With an assumption of such situation, the rotation control device 100 of the present embodiment includes a means for judging whether or not to change a control system of the rotation control device 100 as shown in FIG. 3. To be more specific, the rotation control device 100 includes: a control-system change judging means 140 for judging whether or not a rotation direction of the rotary body 4 is identical with a direction intended by the operator; and a control-system changing means 150 for changing the control system of the rotation control device 100 in accordance with the judgment result and increasing the control command for the electric motor 5 to be larger than a value before the change of the control system. By changing the control system of the rotation control device 100 with the control-system changing means 150, a sufficiently large torque output is generated in the electric motor 5, so that the rotary body 4 is re-pushed and returned by the change amount by which the rotary body has been pushed back. Note that when such large torque output is tried to be obtained by the typical and conventional speed control, the speed gain K must be increased further larger as compared to the present embodiment, which causes motion in normal rotation to become unsmooth and inappropriate in use. The means 140 and 150 will be described later in more detail.

[1-2] Control Structure of Rotation Control Device 100

Now, referring to FIG. 3, the control structure of the rotation control device 100 for controlling the rotary body 4 will be described.

The rotation control device 100 includes a rotation position output means 110, a reference position storage means 120, a control command generating means 130, the control-system change judging means 140 and the control-system changing means 150.

The rotation position output means 110 integrates the rotation speed of the electric motor 5 which is output by the rotation speed sensor 18 and outputs the integrated value as rotation position information of the rotary body 4.

The reference position storage means 120 employs a RAM (Random Access Memory), which stores an output value of the rotation position output means 110 as a reference position. The reference position stored in the reference position storage means 120 is updated depending on a rotation position of the rotary body 4 for each time in accordance with the judgment result of the control-system change judging means 140. Incidentally, although a plurality of means access the reference position storage means 120 to read the reference position therefrom, connecting relation between the reference position storage means 120 and the plurality of other means are omitted in FIG. 3 to prevent the illustration from being complicated and confusing. This is also the same in second, third and fourth embodiments described later.

The control command generating means 130 generates the control command for the electric motor 5 based on the target speed of the rotary body 4 which is set by the target speed setting device 13 and the rotation speed of the electric motor 5 which is sensed by the rotation speed sensor 18 and outputs the generated control command to the electric motor 5. Specifically, the control command generating means 130 compares the target speed set by the target speed setting device 13 and the rotation speed of the electric motor 5 which is fed back to the rotation control device 100 and generates a torque command value for the electric motor 5 by multiplying a deviation from the comparison by the speed gain K. Here, the speed gain K is set by taking into account the operability of the electric rotary excavator 1 and the like. When the speed gain K is too large, the output of the torque becomes rapid, thereby causing the motion of the rotary body 4 to become unsmooth.

As described above, the torque command value for the electric motor 5 is generated based on the deviation of the fed-back rotation speed of the electric motor 5 and the target speed. Therefore, in a case where the actual speed does not increase even when the rotation lever 10 is tilted to a large extent, the control command generating means 130 increases the torque command value so that the actual speed becomes close to the target speed. Note that such control is a speed control performed by a typical P control.

The control-system change judging means 140 judges whether or not the rotary body 4 is positioned on a side opposite to an operated direction that is requested by the operator using the rotation lever 10. Specifically, the control-system change judging means 140 judges whether or not to update the reference position stored in the reference position storage means 120 based on an actual rotation position of the rotary body 4 which is output by the rotation position output means 110, the reference position before the update which is stored in the reference position storage means 120 and the operated direction of the rotation lever 10 (i.e., operated rotation direction and tilted direction). That is to say, when the rotation position of the rotary body 4 is positioned on the side opposite to the operated direction that is requested by the operator using the rotation lever 10, the control-system change judging means 140 judges that the rotary body 4 is not rotated even though the rotation lever 10 is tilted.

The control-system changing means 150 changes the control system of the rotation control device 100 in accordance with the judgment result of the control-system change judging means 140 to increase the control command for the electric motor 5 to have a value larger than that before the change of the control system. The control-system changing means 150 includes a reference position update section 150A, a change command generator 150B and a comparator (control command output section) 150C.

Each of the components of the control-system changing means 150 will be described below.

The reference position update section 150A updates the reference position stored in the reference position storage means 120 based on the judgment result of the control-system change judging means 140. While the reference position update section 150A updates the reference position in normal rotation, the reference position update section 150A does not update but maintains the reference position when the control-system change judging means 140 judges that the rotary body 4 is positioned on the side opposite to the direction requested via the rotation lever 10.

The change command generator 150B generates a change command for the electric motor 5 based on the output value of the rotation position output means 110 and the reference position stored in the reference position storage means 120. As shown in FIG. 6, the change command generator 150B performs a position control by the P control where the rotation position of the rotary body 4 is multiplied by a position gain Kp1. When the reference position update section 150A does not update but maintains the reference position, the change command generator 150B generates a change command value that is larger than the value before the change of the control system.

Referring back to FIG. 3, the comparator 150C outputs to the electric motor 5 a larger value out of the change command value generated by the change command generator 150B and the control command value generated by the control command generating means 130 as a control command for the electric motor 5. Accordingly, in a case where the reference position is not updated and the torque output computed in the typical speed control (i.e., torque output equal to or lower than the torque limit-a) yields to the earth pressure and might cause the rotary body 4 to be pushed back to a large extent, the comparator 150C can select the larger change command value generated by the change command generator and output it as the control command for the electric motor 5 to restrict the rotation of the rotary body 4.

[1-3] Control Operation of Rotation Control Device 100

Figure 4:
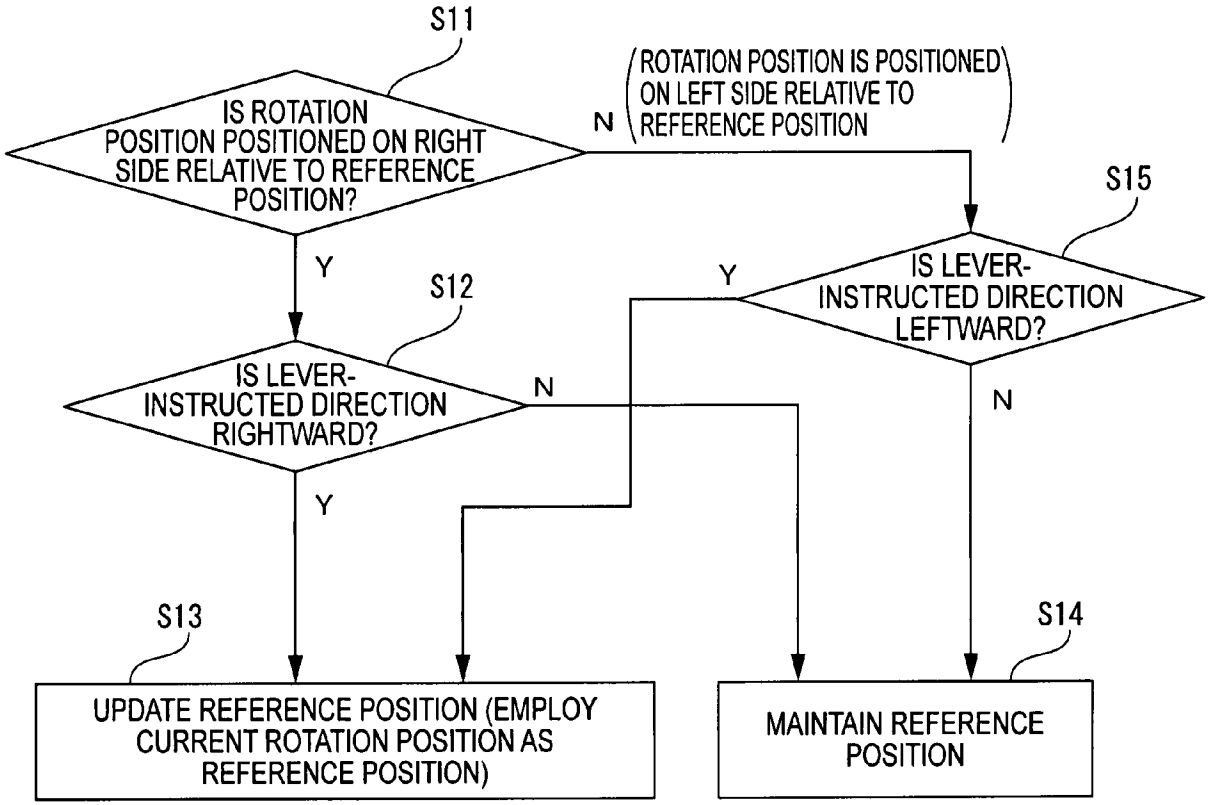
FIG. 4 is a flowchart showing how a reference position is updated according to the first embodiment.
Figure 5:
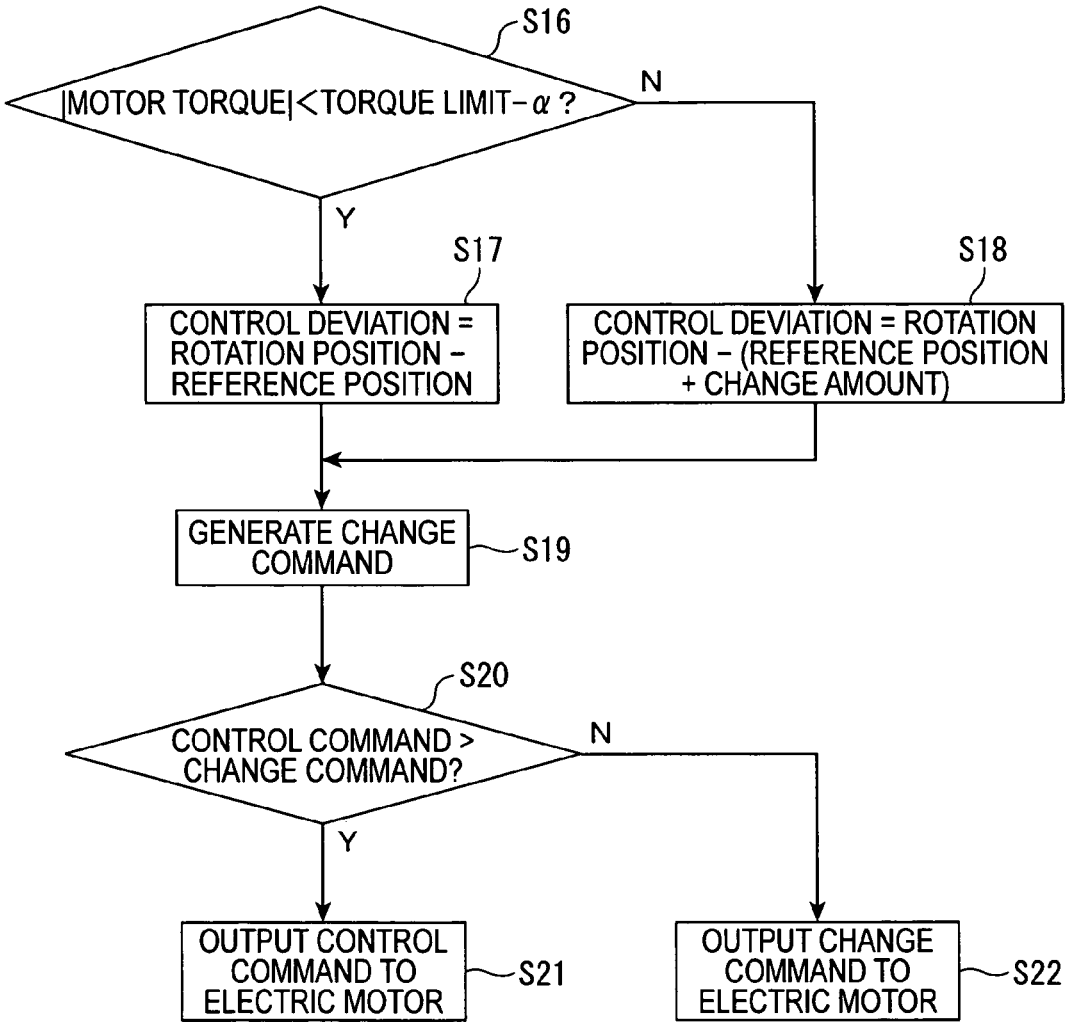
FIG. 5 is a flowchart showing how a control command is output according to the first embodiment.

Now, the operation of rotation control device 100, especially the operations of control-system change judging means 140 and the control-system changing means 150 will be described with reference to FIGS. 4 to 6.

First, referring to FIG. 4, how the reference position is updated by the control-system change judging means 140 and the control-system changing means 150 will be described.

After a step in which the rotation position output means 110 integrates the rotation speed of the electric motor 5 which is output by the rotation speed sensor 18 and outputs the integrated value as the rotation position information of the rotary body 4, the control-system change judging means 140 judges whether or not the rotation position of the rotary body 4 which is output by the rotation position output means 110 is positioned on the right side relative to the reference position stored in the reference position storage means 120 (Step 11: in the description hereinafter and in the drawings, "Step" will be abbreviated simply as "S").

When the rotary body 4 is positioned on the right side relative to the reference position, the control-system change judging means 140 judges whether or not an instructed direction instructed by tilting of the rotation lever 10 is rightward or not (S12). When the judgment result shows that the instructed direction by the rotation lever 10 is rightward, it is judged that an actual rotation direction corresponds to the instructed direction, and therefore the reference position update section 150A of the control-system changing means 150 updates the reference position stored in the reference position storage means 120 with each current rotation position of the rotary body 4 which is changed rightward with the elapse of time, the each current rotation position continuously replacing the reference position (S13).

When the control-system change judging means 140 judges that the instructed direction of the lever is leftward in S12, the rotary body 4 rotates rightward even though the operator tilts the rotation lever 10 toward the leftward rotation side. Accordingly, the control-system change judging means 140 judges that the rotary body 4 is pushed back rightward even though the operator desires to rotate the rotary body 4 leftward, the reference position before the judgment is maintained. In other words, the reference position update section 150A does not update the reference position (S14).

Referring back to S11, when the rotation position is not on the right side of the reference position, namely when the rotary body 4 is actually rotated leftward, the control-system change judging means 140 judges whether or not the instructed direction of the lever is leftward (S15). When the judgment result shows that the instructed direction is leftward, it is judged that the actual rotation direction corresponds to the instructed direction, and therefore the reference position update section 150A updates the reference position stored in the reference position storage means 120 with each current rotation position of the rotary body 4 which is changed leftward with the elapse of time, the each current rotation position continuously replacing the reference position (S13).

When the control-system change judging means 140 judges that the instructed direction of the lever is rightward in S15, the rotary body 4 rotates leftward even though the operator tilts the rotation lever 10 toward the rightward rotation side. Accordingly, the control-system change judging means 140 judges that the rotary body 4 is pushed back leftward even though the operator desires to rotate the rotary body 4 rightward, so that the reference position before the judgment is maintained. In other words, the reference position update section 150A does not update the reference position.

Next, how the control command for the electric motor 5 is generated will be described with reference to FIG. 5.

After the judgment by the control-system change judging means 140 and the update or the maintaining of the reference position by the reference position update section 150A of the control-system changing means 150, the change command generator 150B of the control-system changing means 150 judges whether or not an actual motor torque of the electric motor 5 exceeds the torque limit-α (S16). Based on the judgment result, the change command generator 150B switches computation of a control deviation for generating the change command. When the actual motor torque of the electric motor 5 is judged to be smaller than the torque limit-α, the change command generator 150B employs a difference between the output value of the rotation position output means 110 and the reference position stored in the reference position storage means 120 as the control deviation (S17). On the other hand, when the actual motor torque of the electric motor 5 is judged to be equal to or larger than the torque limit-α, the change command generator 150B employs a difference between a position obtained by adding a change amount to the reference position stored in reference position storage means 120 and the output value of the rotation position output means 110 as the control deviation (S18).

Then, the change command generator 150B generates the change command for the electric motor 5 based on the obtained control deviation (S19). The change command is generated by the proportional control in which the control deviation is multiplied by the position gain Kp1.

Then, the comparator 150C of the control-system changing means 150 judges whether or not the control command generated by the control command generating means 130 is greater than the change command generated by the change command generator 150B (S20). When the control command generated by the control command generating means 130 is greater, the comparator 150C selects the control command as the control command for the electric motor 5 and outputs the control command to the electric motor 5 (S21). On the other hand when the change command generated by the change command generator 150B is greater, the comparator 150C selects the change command as the control command for the electric motor 5 and outputs the change command to the electric motor 5 (S22).

Next, referring to FIG. 6, how a normal control and a control for preventing the rotary body 4 from being pushed back are performed by the control-system change judging means 140 and the control-system changing means 150 will be described.

When the actual rotation direction of the rotary body 4 corresponds to the instructed direction of the rotation lever 10, the rotary body 4 is in a normal rotation state, and therefore the reference position update section 150A of the control-system changing means 150 constantly updates the reference position based on the judgment result of the control-system change judging means 140. For easier understanding of this process, the update of the reference position performed by the reference position update section 150A is shown by a virtual switch 30 in FIG. 6. Therefore, in this case, the reference position update section 150A switches the switch 30 to "Y". Also, in the normal rotation state, the motor torque of the electric motor 5 is output within the torque limit-α. In computation of the control deviation at this time, switching of a computation value performed by the change command generator 150B of the control-system changing means 150 is also shown by a virtual switch 31. Therefore, in this case, the change command generator 150B switches the switch 31 toward "Y".

In this state, a position command (θ1) and a position command (θ2) that have passed through the switches 30, 31 each correspond to the current rotation position of the rotary body 4 and represent a common value at the current rotation position, which are canceled to be "0 (zero)". Accordingly, a torque output value generated by the change command generator 150B is also "0", so that the change command generator 150B outputs a torque command value of "0" to the comparator 150C. Then, the comparator 150C judges that the torque command value based on the target speed is larger and outputs this torque command value to the electric motor 5 as the control command. In other words, the electric motor 5 can obtain the torque output according to the rotation operation by the rotation lever 10 which is generated by the control command generating means 130, i.e., the electric motor 5 can obtain the torque output that is controlled by the typical speed control according to the deviation between the target speed and the actual speed.

In contrast, when the rotary body 4 is pushed back leftward due to external force such as the earth pressure even though the rotation lever 10 is tilted toward the rightward rotation side, the reference position update section 150A does not update the reference position as describer above, so that the reference position update section 150A switches the switch 30 to "N".

In this state, since the reference position is not updated, the current position of the rotary body 4 differs from the reference position. Accordingly, the difference between the position command (θ1) as the current rotation position of the rotary body 4 and a position command (θ0) as the reference position is not "0". The change command generator 150B generates a torque output corresponding to the difference which is not "0" and outputs the torque output to the comparator 150C as the torque command value. The torque command value at this time is larger than the torque command value based on the target speed due to the setting of the position gain Kp1, the comparator 150C employs the torque command value from the change command generator 150B with higher priority.

As described above, by employing with higher priority the torque command value from the change command generator 150B as the control command to be output to the electric motor 5, even when the rotary body 4 receives the external force in an opposite direction to the operated rotation direction of the rotary body 4, the torque command value can be increased and a pushed-back amount of the rotary body 4 in the opposite direction can be minimized, so that the rotary body 4 can be re-pushed and returned to and balanced at the previous reference position.

Incidentally, in FIG. 1, an equivalent model for restricting the rotation of the rotary body 4 in the opposite direction is shown by a spring 60. The torque output of the electric motor 5 that can be obtained by the torque command value from the change command generator 150B corresponds to the spring force of the spring 60.

Meanwhile, referring back to FIG. 6, in a case where the rotary body 4 is pushed back in the opposite direction to the operated direction and the rotary body 4 is tried to be re-pushed and returned to the reference position using the torque command value generated by the change command generator 150B, there is a possibility where an actual motor torque of the electric motor 5 exceeds the torque output of the torque-limit α. In such case, the change command generator 150B switches the switch 31 to "N".

In this case, a change amount Δθ is added to the position command (θ0) as the reference position to generate a position command (θ3), where a difference between the position command (θ3) and the position command (θ1) is employed as the control deviation in the change command generator 150B. Here, when the torque command value exceeds the torque limit-α, the switch 31 is switched toward "N", and the reference position is updated with the position command (θ3) obtained by adding the change amount Δθ to the reference position before the update. Accordingly, the reference position during the time period when the torque command value exceeds the torque limit-α is a position obtained by adding an integrated value of the change amount Δθ (i.e., a displacement amount after the torque command value exceeds the torque limit-α) to the reference position at the time when the rotary body 4 starts to be pushed back in the opposite direction to the operated direction.

Accordingly, since the difference between the above-described position command (θ3) and position command (θ1) is a result obtained by subtracting from the current rotation position of the rotary body 4 the position obtained by adding the displacement amount after the torque command value exceeds the torque limit-α to the reference position at the time when the rotary body 4 starts to be pushed back in the opposite direction to the operated direction, the difference corresponds to a difference between the position at the time when the rotary body 4 starts to be pushed back in the opposite direction to the operated direction and the position where the torque command value exceeds the torque limit-α. This difference equals to a deviation at the time when the torque command value exceeds the torque limit-α. Accordingly, the torque command value is maintained to be the value at the time when exceeding the torque limit-α, thereby maintaining a balanced condition with this torque. In other words, the rotary body 4 will not be re-pushed and returned further to the reference position. If such control is not performed and the reference position is not updated, the rotary body 4 continues to be re-pushed and returned to the reference position with a large torque, which causes an unstable condition where the rotary body 4 is re-pushed and returned with a large force when the rotary body 4 is suddenly released from the external force.

[1-4] Advantages of Embodiment

According to the present embodiment, the following advantages can be attained.

(1) In the electric rotary excavator 1, when the earth pressure acts on the rotary body 4 in the opposite direction to the instructed direction of the rotation lever 10, the comparator 150C increases the torque output of the electric motor 5 that drives the rotary body 4, thereby appropriately reacting against the acting earth pressure and securely preventing the rotary body 4 from keeping rotating in the opposite direction. Accordingly, even when the earth pressure becomes larger, the work will not be affected. In addition, when the rotary body 4 is rotated on a slope, the rotary body 4 can be prevented from being rotated back greatly due to the weight of the boom 6 and the arm 7.

(2) Since the torque command value for the electric motor 5 that drives the rotary body 4 is changed to change the torque output of the rotary body 4, the torque output of the electric motor 5 can be changed by the electric control, which makes it unnecessary to provide a large-scale device and prevents the cost from greatly increasing.

(3) Since the speed gain K is not increased in order to generate the large torque output in the electric motor 5, an excessively large torque output is not generated during the normal rotation, thereby preventing unsmooth motion of the electric rotary excavator 1 and enhancing comfortableness in riding and operability.

Second Embodiment

Figure 7:
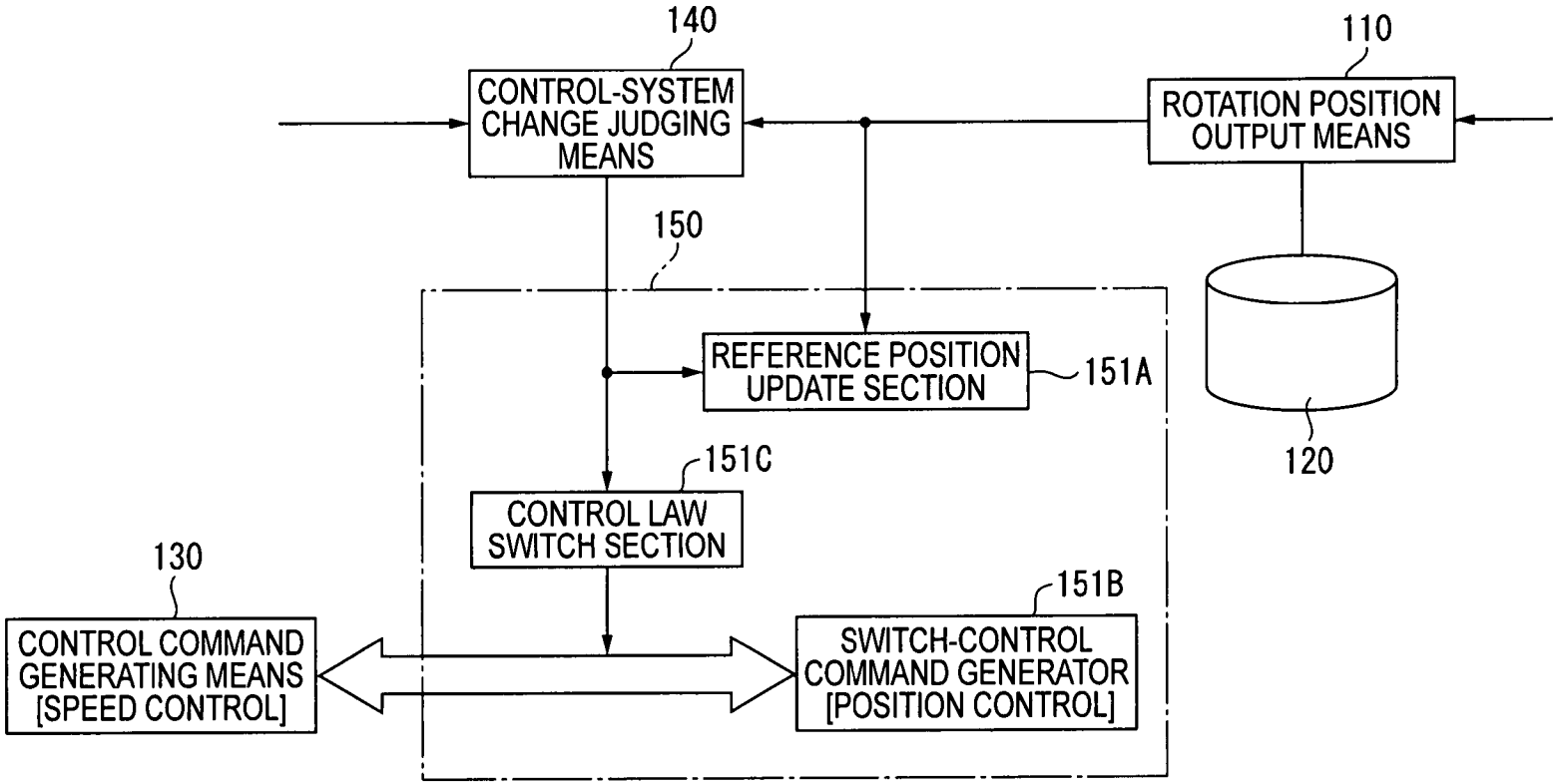
FIG. 7 is an illustration showing a control according to a second embodiment of the present invention.
Figure 8:
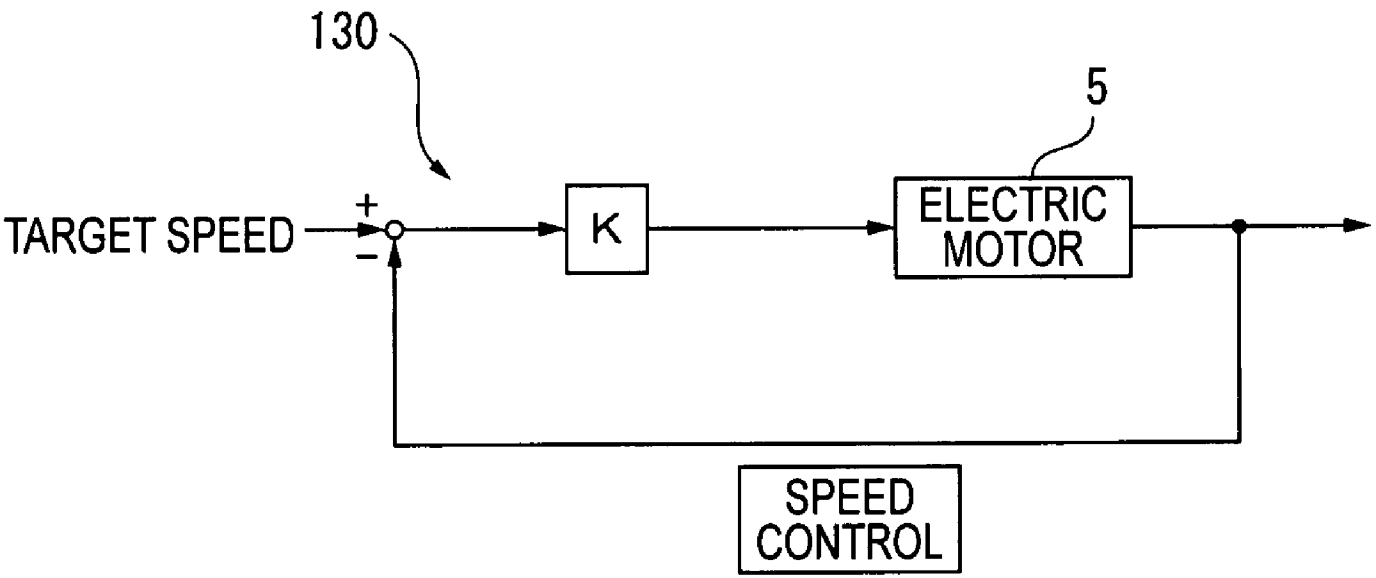
FIG. 8 is a block diagram showing one control law according to the second embodiment.
Figure 9:
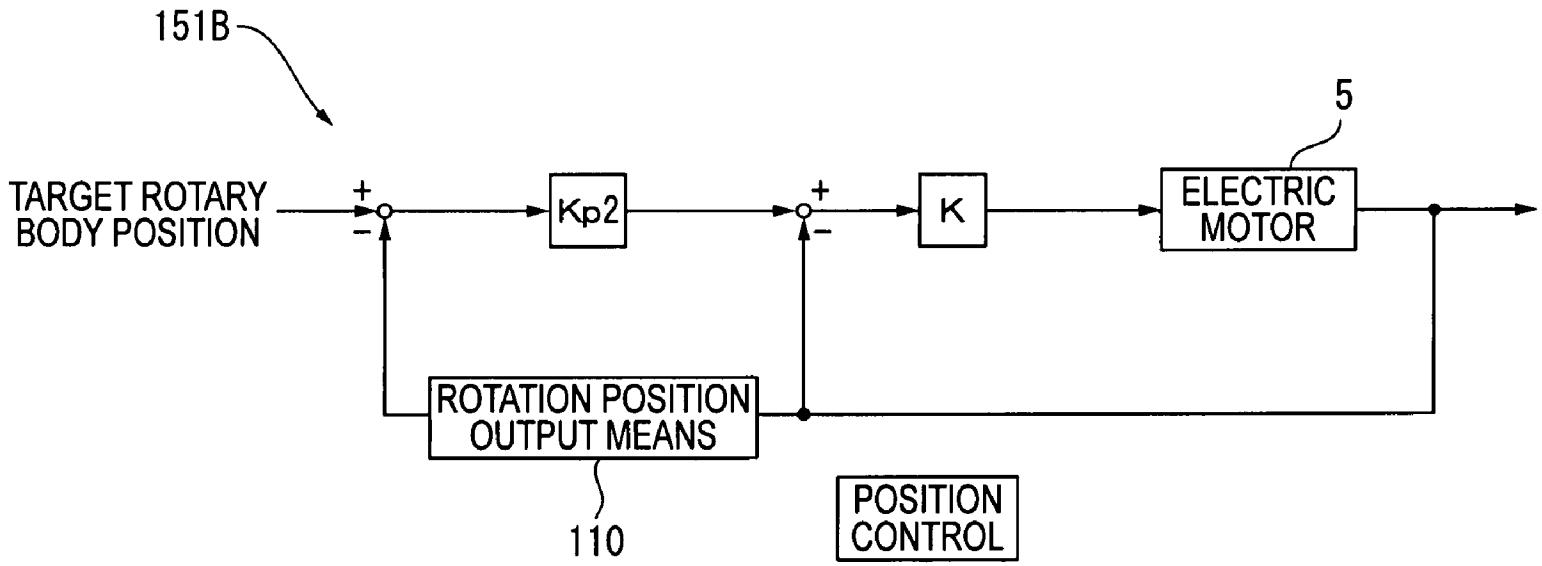
FIG. 9 is a block diagram showing the other control law according to the second embodiment.

A second embodiment shown in FIGS. 7 to 9 is different from the first embodiment in that: the control-system changing means 150 includes, as shown in FIG. 7, a reference position update section 151A, a switch-control command generator 151B and a control law switch section 151C; and the control law switch section 151C switches a control law from the control command generating means 130 to the switch-control command generator 151B to increase a control command value for the electric motor 5 to be larger than a value before the change of the control system in changing the control system of the rotation control device 100. Thus, in the present embodiment, only such different part from the first embodiment will be described. Incidentally, the speed control shown in FIG. 8 is completely the same as the speed control by the control command generating means 130 of the first embodiment.

Each of the components of the control-system changing means 150 will be described below.

Similarly to the first embodiment, the reference position update section 151A updates the reference position stored in the reference position storage means 120 based on the judgment result of the control-system change judging means 140.

As shown in FIG. 9, the switch-control command generator 151B generates and outputs the control command for the electric motor 5 by a control law different from that of the control command generating means 130. Specifically, the switch-control command generator 151B performs a position control using a fed-back value of the current position output by the rotation position output means 110 so that the rotary body 4 is re-pushed and returned by an amount by which the rotary body 4 has been pushed back in the opposite direction. In such position control, a position gain Kp2 is so set that a target speed that is required to re-push and return the rotary body 4 to a target rotary body position (which is the reference position and coincides with a position of the rotary body 4 just before being pushed back in the opposite direction) is generated, and the rotary body 4 is re-pushed and returned in the operated rotation direction with a larger torque output based on the target speed obtained by multiplying the position gain Kp2.

Referring back to FIG. 7, the control law switch section 151C switches the control law between the control command generating means 130 and the switch-control command generator 151B based on the judgment result of the control-system change judging means 140. With the switching of the control law, the rotary body 4 can be prevented from rotating in the opposite direction to the operated rotation direction without changing the speed gain K.

Figure 10:
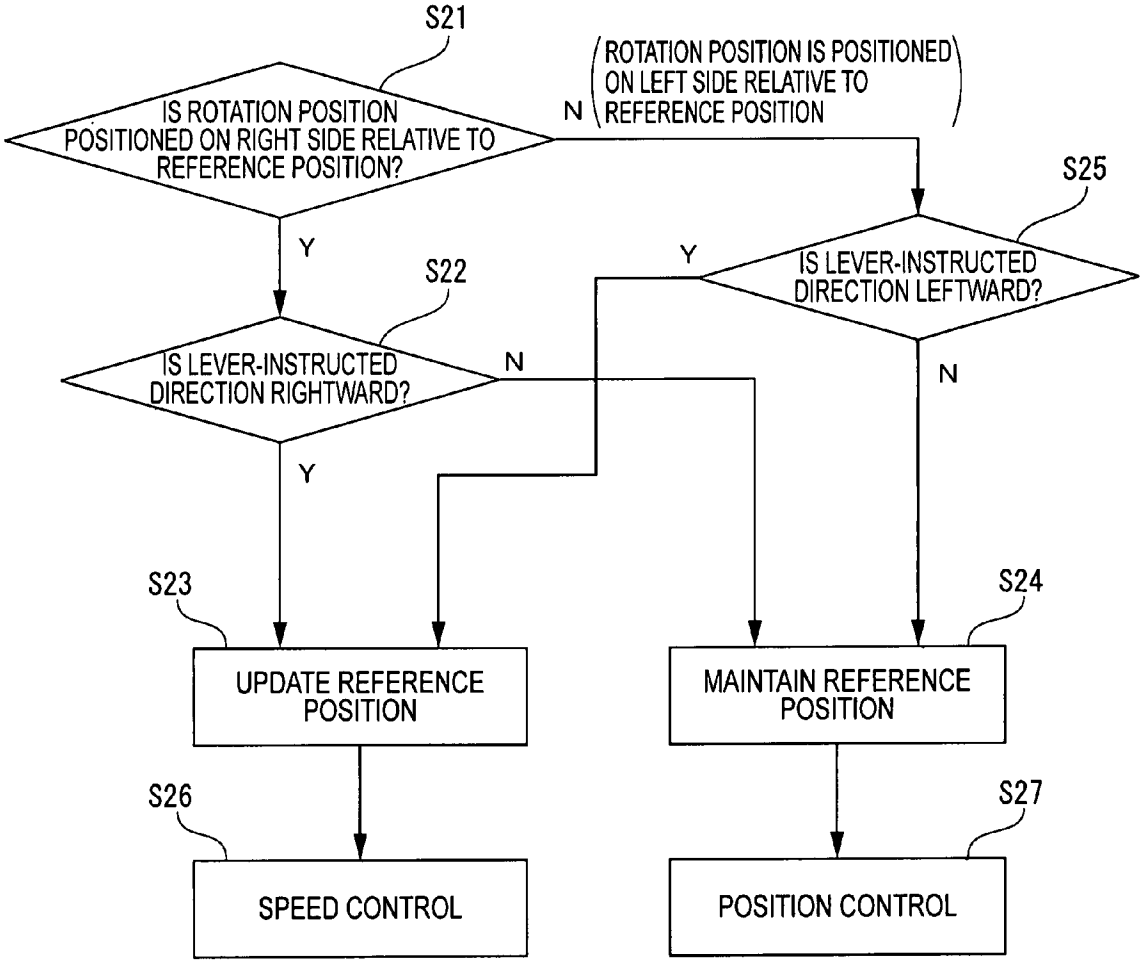
FIG. 10 is a flowchart showing how the control laws are switched according to the second embodiment.

Next, referring to FIG. 10, how the control law is switched by the control-system change judging means 140 and the control-system changing means 150 will be described.

In the present embodiment, the control law switch section 151C of the control-system changing means 150 switches the control law from the speed control by the control command generating means 130 to the position control by the switch-control command generator 151B of the control-system changing means 150 based on the judgment on whether or not the rotary body 4 is pushed back in the opposite direction. As shown in FIG. 10, a flow for a switching judgment at this time is completely the same as the flow for the update of the reference position in the first embodiment. Specifically, as a result of the flow that is the same as the flow for updating the reference position, the control law switch section 151C selects the speed control by the control command generating means 130 in S26, and as a result of the flow that is the same as the flow for not updating the reference position, the control law switch section 151C switches the control law to the position control by the switch-control command generator 151B of the control-system changing means 150 in S27. At this time, as the result of the flow that is the same as the flow for the update of the reference position, the reference position update section 151A of the control-system changing means 150 also updates (S23) or maintains (S24) the reference position. S21, S22 and S25 are the same as those in the first embodiment, the description of which will be omitted.

Next, how a control command is generated after the switching of the control law will be described with reference to FIG. 9.

After the control law switch section 151C switches the control law, the switch-control command generator 151B generates a control command for the electric motor 5 by the position control. In the position control, the rotation position of the rotary body 4 which is output by the rotation position output means 110 is fed back based on the rotation speed of the electric motor 5 which is output by the rotation speed sensor 18. With the arrangement, the switch-control command generator 151B performs a control for re-pushing and returning the rotary body 4 by an amount by which the rotary body 4 has been pushed back in the opposite direction.

In such position control, the position gain Kp2 is so set that a target speed that is required to repush and return the rotary body 4 to a target rotary body position (which is the reference position and coincides with the position of the rotary body 4 just before being pushed back in the opposite direction) is generated, and the switch-control command generator 151B generates a larger torque command value based on the target speed obtained by multiplying the position gain Kp2 until the rotary body 4 is re-pushed and returned to the reference position. With the arrangement, the rotation control device 100 performs the control for re-pushing and returning the rotary body 4 in the operate direction by the amount by which the rotary body 4 has been pushed back in the opposite direction.

In the present embodiment, the control is performed such that the current position of the rotary body 4 is fed back and the target speed according to the deviation from the target rotation position is output by multiplying the position gain Kp2 only when the rotary body 4 starts rotating in the opposite direction, thereby attaining advantages similar to those in the first embodiment. Specifically, the rotary body 4 can be prevented from keeping rotating in the opposite direction while appropriately maintaining comfortableness in riding during the normal rotation.

Third Embodiment

Figure 11:
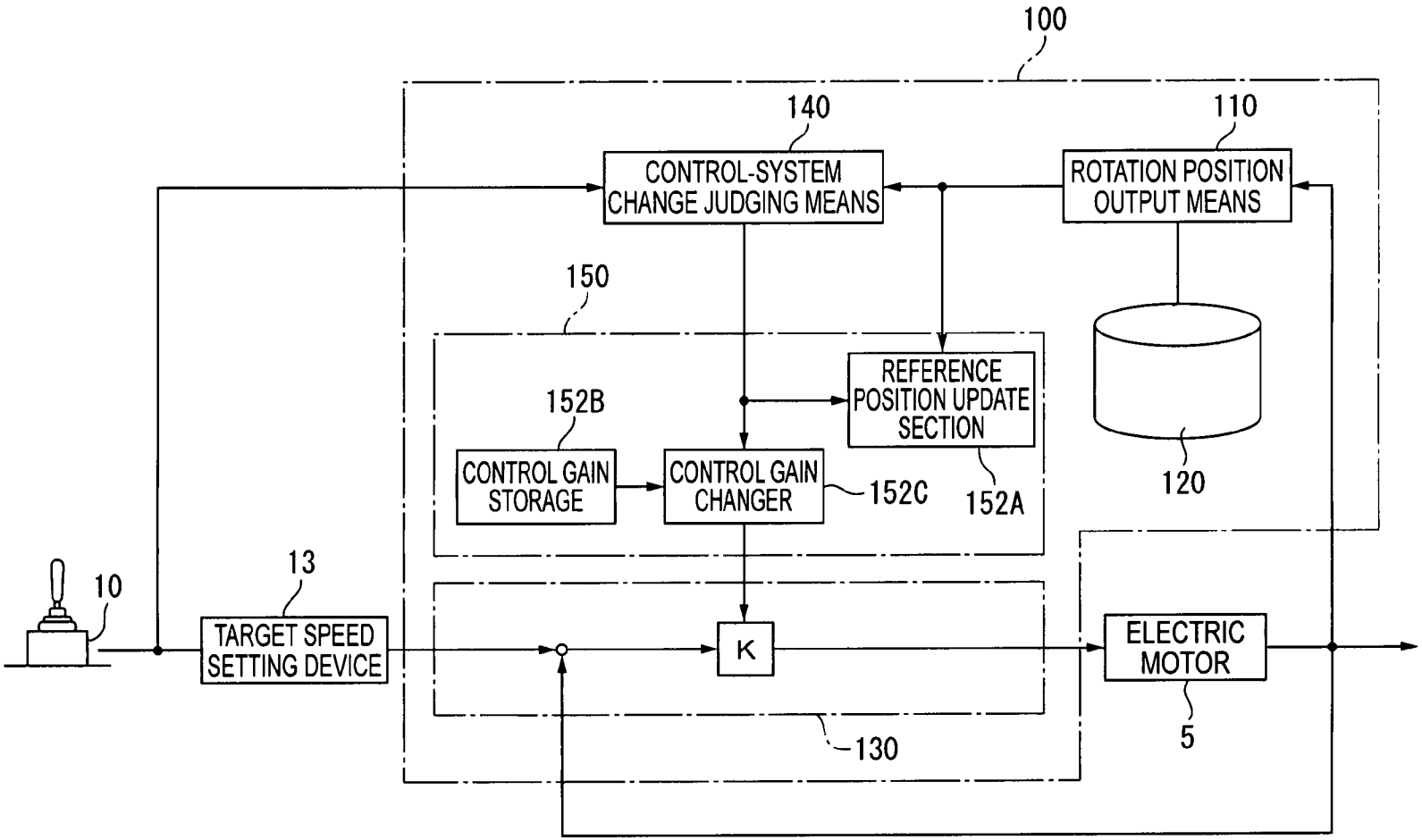
FIG. 11 is a block diagram showing a control structure according to a third embodiment of the present invention.
Figure 12:
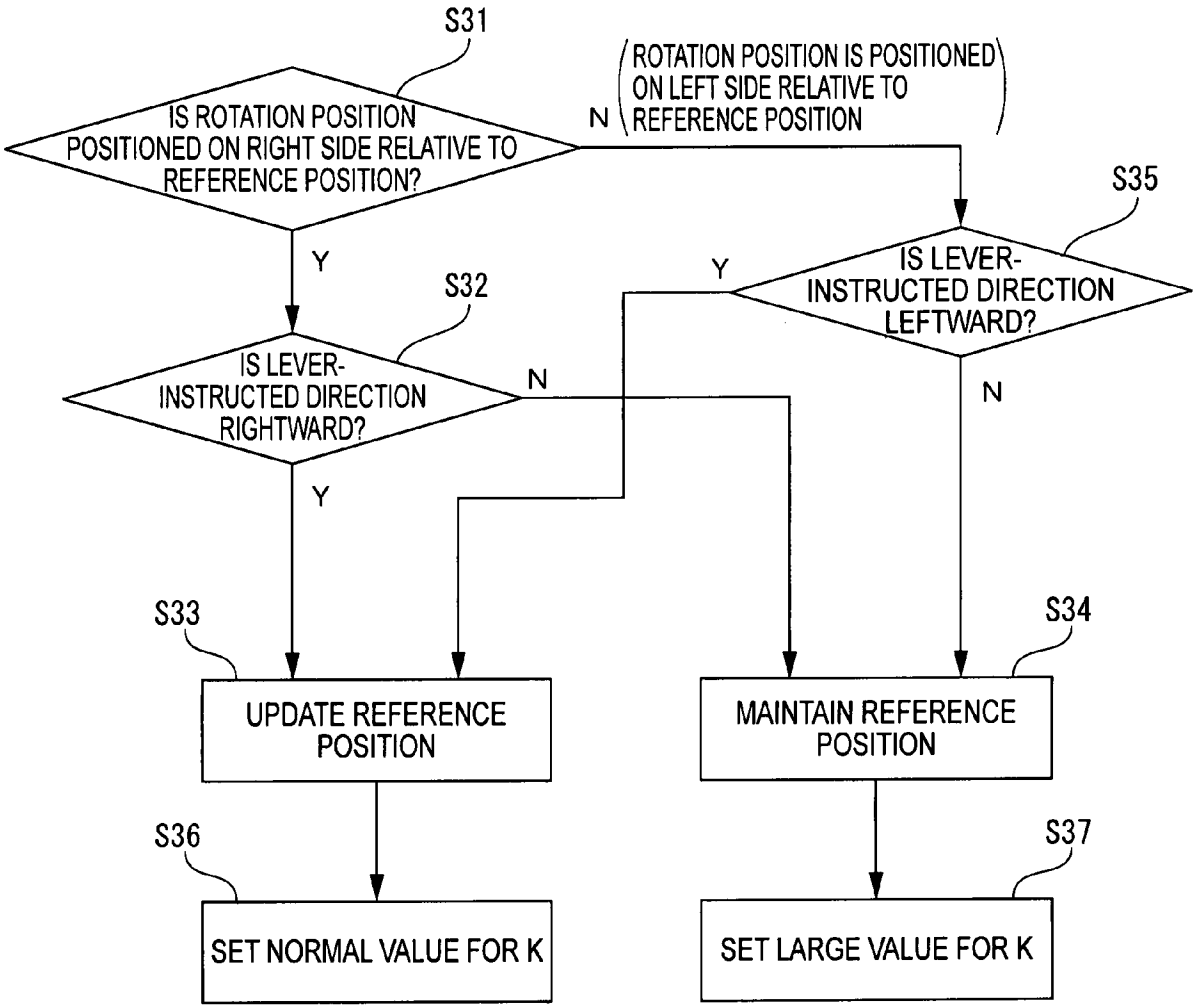
FIG. 12 is a flowchart showing how a control gain is changed according to the third embodiment.

A third embodiment shown in FIGS. 11 and 12 is different from the first embodiment in that: the control-system changing means 150 includes, as shown in FIG. 11, a reference position update section 152A, a control gain storage 152B and a control gain changer 152C; and the control gain changer 152C changes a control gain to increase a control command value for the electric motor 5 to be larger than a value before the change of the control system in changing the control system of the rotation control device 100. Thus, in the present embodiment, only such different part from the first embodiment will be described.

Each of the components of the control-system changing means 150 will be described below.

As in the first and second embodiments, the reference position update section 152A updates the reference position stored in the reference position storage means 120 based on the judgment result of the control-system change judging means 140.

The control gain storage 152B stores a plurality of speed gains as control gains for the rotary body 4.

The control gain changer 152C changes a control gain selected from the control gain storage 152B in accordance with the judgment result of the control-system change judging means 140. Specifically, the control gain changer 152C increases the torque command value as the control command by changing a speed gain selected from the control gain storage 152B to be a larger value when the rotary body is pushed back in the opposite direction to the operated rotation direction. With the arrangement, the torque output of the electric motor 5 is increased, thereby re-pushing and returning the rotary body 4 by the amount by which the rotary body 4 has been pushed back in the opposite direction.

Next, referring to FIG. 12, how the control gain is changed by the control-system change judging means 140 and the control-system changing means 150 will be described.

In the present embodiment, the control gain is changed by the control gain changer 512C of the control-system changing means 150 based on the judgment on whether or not the rotary body 4 is pushed back in the opposite direction. As shown in FIG. 12, a flow for a judgment for changing the speed gain K as the control gain from a normal value to a larger value at this time is completely the same as the flow for the update of the reference position in the first embodiment. Specifically, as a result of a flow that is the same as the flow for updating the reference position, the control gain changer 152C maintains the control gain to be the normal value (S36), and as a result of a flow that is the same as the flow for not updating the reference position, the control gain changer 152C changes the control gain to be the larger value as compared to the normal value (S37). At this time, as the result of the flow that is the same as the flow for the update of the reference position, the reference position update section 152A of the control-system changing means 150 also updates (S33) or maintains (S34) the reference position. S31, S32 and S35 are the same as those in the first embodiment, the description of which will be omitted.

The speed control performed by the control command generating means 130 is the same as the speed control in the first embodiment except the change of the control gain performed by the control gain changer 152C, the description of which will be omitted.

In the present embodiment, during the normal speed control, the speed gain K is maintained to be the normal value and the speed gain K is increased to prevent the rotary body 4 from continuing to be pushed back in the opposite direction only when the rotary body 4 is pushed back in the opposite direction. Therefore, similarly to the first and second embodiments, the present embodiment can achieve the object of the present invention while properly maintaining the comfortableness in riding.

Fourth Embodiment

Figure 13:
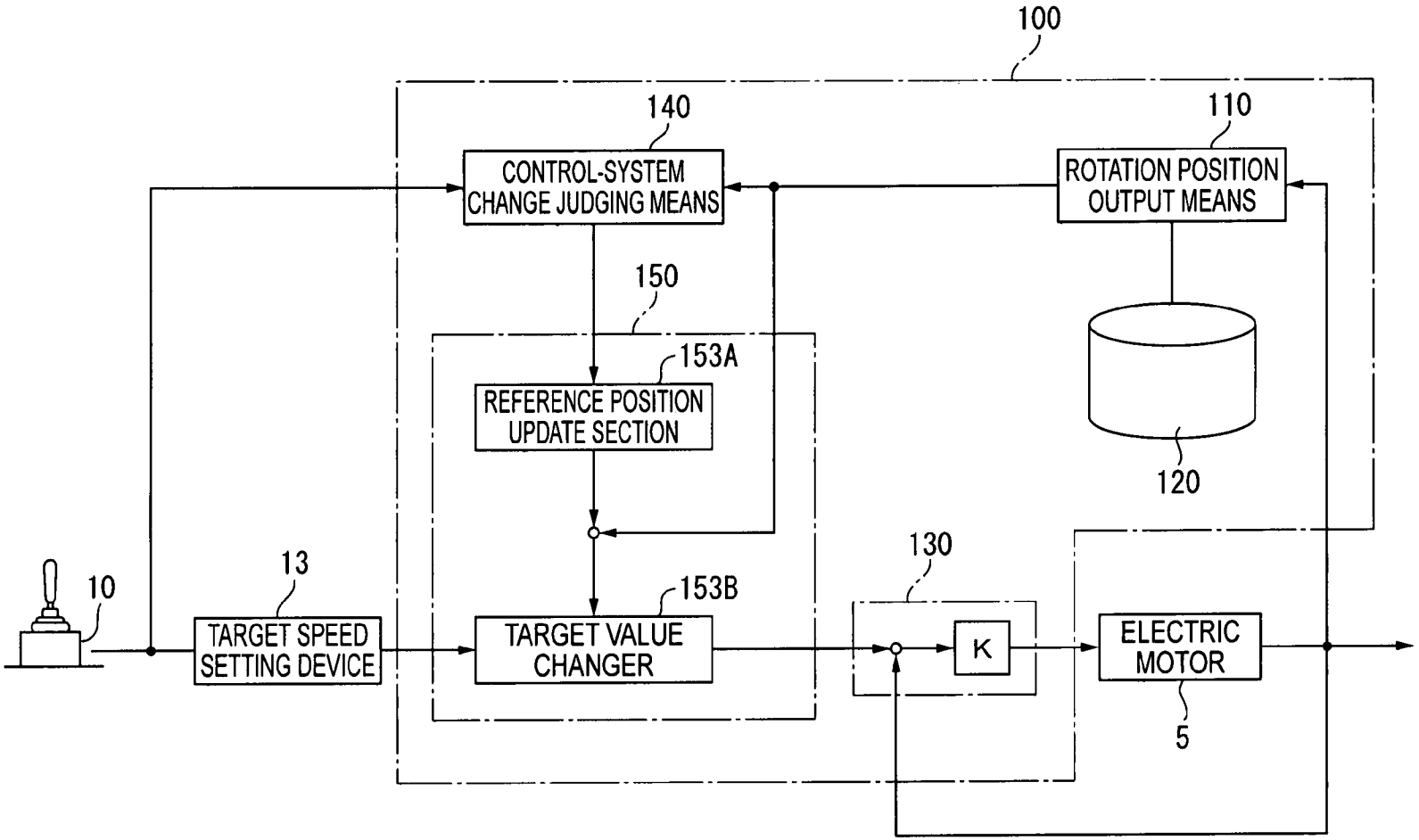
FIG. 13 is a block diagram showing a control structure according to a fourth embodiment of the present invention.

A fourth embodiment shown in FIG. 13 is different from the first embodiment in that: the control-system changing means 150 includes, as shown in FIG. 13, a reference position update section 153A and a target value changer 153B; and the target value changer 153B changes a target value of the rotary body 4 to increase a control command value for the electric motor 5 to be larger than a value before the change of the control system in changing the control system of the rotation control device 100. Thus, in the present embodiment, only the different part from the first embodiment will be described.

Each of the components of the control-system changing means 150 will be described below.

Similarly to the first to third embodiments, the reference position update section 153A updates the reference position stored in the reference position storage means 120 based on the judgment result of the control-system change judging means 140.

The target value changer 153B changes the target speed as a control target value for the rotary body 4 which is set based on an operation input at the rotation lever (operating section) 10 based on the output value of the rotation position output means 110 and the reference position stored in the reference position storing means 120. Specifically, when the rotary body 4 is pushed back in the opposite direction to the operated rotation direction, the target value changer 153B changes the target speed set by the target speed setting device 13 to be a larger value based on the deviation between the output value of the rotation position output means 110 and the reference position stored in the reference position storing means 120. At this time, similarly to the first embodiment, the deviation is changed to "0" or other values in accordance with the update or the maintaining of the reference position. By changing the target speed set by the target speed setting device 13 to be the larger value, the target value changer 153B performs a control in which the rotation lever 10 is imaginarily tilted down more strongly to increase the torque output of the electric motor 5, thereby pushing and returning the rotary body 4 by the amount by which the rotary body 4 has been pushed back in the opposite direction.

Incidentally, the control of the present embodiment employs the position control similar to the second embodiment. In the normal rotation state where the rotary body 4 is pushed back in the opposite direction, the speed control is employed similarly to the second embodiment shown in FIG. 9.

However, the present embodiment is different from the second embodiment in the following point: in the position control in the second embodiment, a large target speed is generated, separately from the target speed set by the target speed setting device 13, by multiplying by the position gain Kp2 the deviation between the target rotary body position as the position of the rotary body 4 at the reference position and just before being pushed back in the opposite direction and the actual current position, while in the present embodiment, the target speed itself that is set by the target speed setting device 13 is changed based on the operation input at the rotation lever 10 on the basis of the deviation. Since the judgment on whether to update or maintain the reference position is completely the same as the flow for the update of the reference position in the first embodiment, illustration and description of which will be omitted.

In the present embodiment, since the rotation control device 100 includes the target value changer 153B for changing the target speed based on the deviation of the positions, thereby achieving the object of the present invention.

Incidentally, the present invention is not limited to the embodiments described above, but includes other components or the like that can achieve the object of the present invention, and also include modifications as shown below.

For example, a restricting device for mechanically preventing the rotary body from rotating in the opposite direction may be added, the restricting device including those shown in first and second modifications below.

[First Modification]

Figure 14:
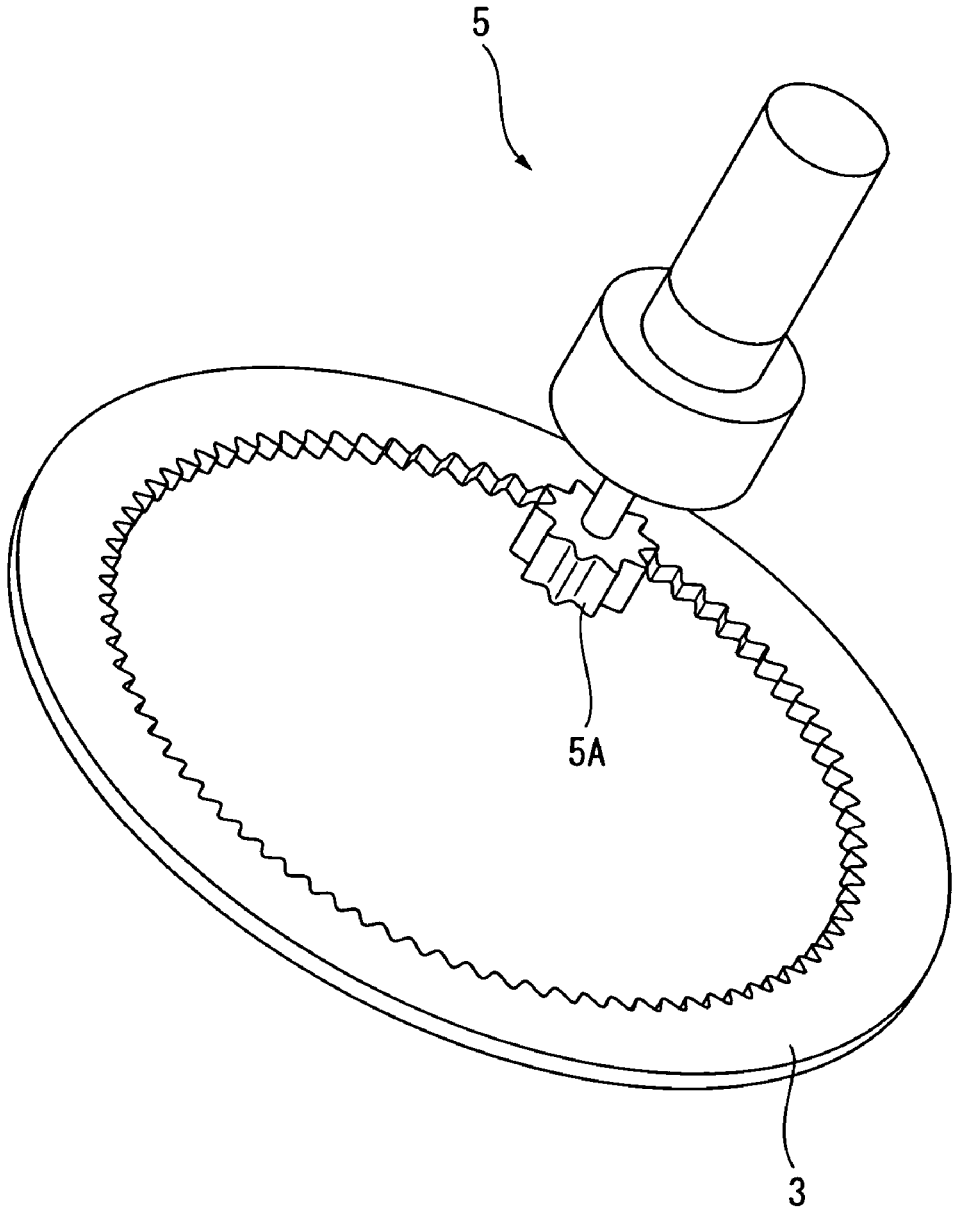
FIG. 14 is a perspective view showing a first modification of the present invention.
Figure 15:
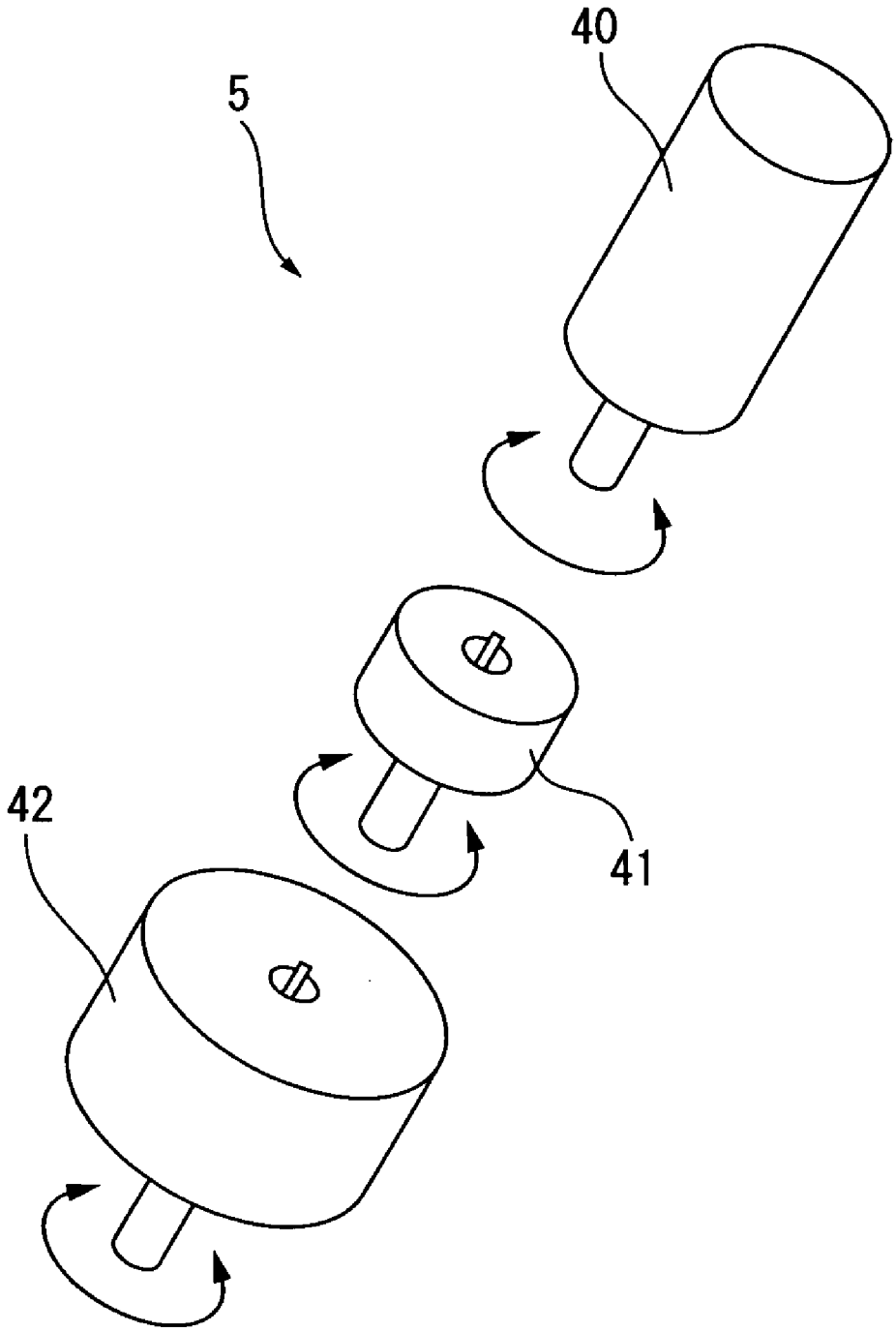
FIG. 15 is an exploded perspective view showing a restricting device of the first modification.

FIGS. 14 and 15 each schematically show a primary part of the first modification.

The electric motor 5 shown in FIG. 14 which engages with the swing circle 3 via a gear 5A includes a motor body 40, a restricting device 41 embedding a ratchet mechanism for transferring a rotational force in only one direction of the motor body 40 and a reduction gear 42 as shown in FIG. 15. A rotation restricting direction of the restricting device 41 is so arranged as to be switched by a switch signal output in accordance with the operated direction of the rotation lever.

With the arrangement, when the rotation lever is operated toward the rightward rotation side, the restricting device 41 operates so as to restrict the leftward rotation, while the rotation lever is operated toward the leftward rotation side, the restricting device 41 operates so as to restrict the rightward rotation. Accordingly, when the rotary body receives the external force in the opposite direction to the operated rotation direction, the restricting device 41 mechanically restricts the rotation of the rotary body in the opposite direction, thereby securely reacting against the external force and thus securely preventing the rotary body from keeping rotating in the opposite direction to the operated direction.

[Second Modification]

Figure 16:
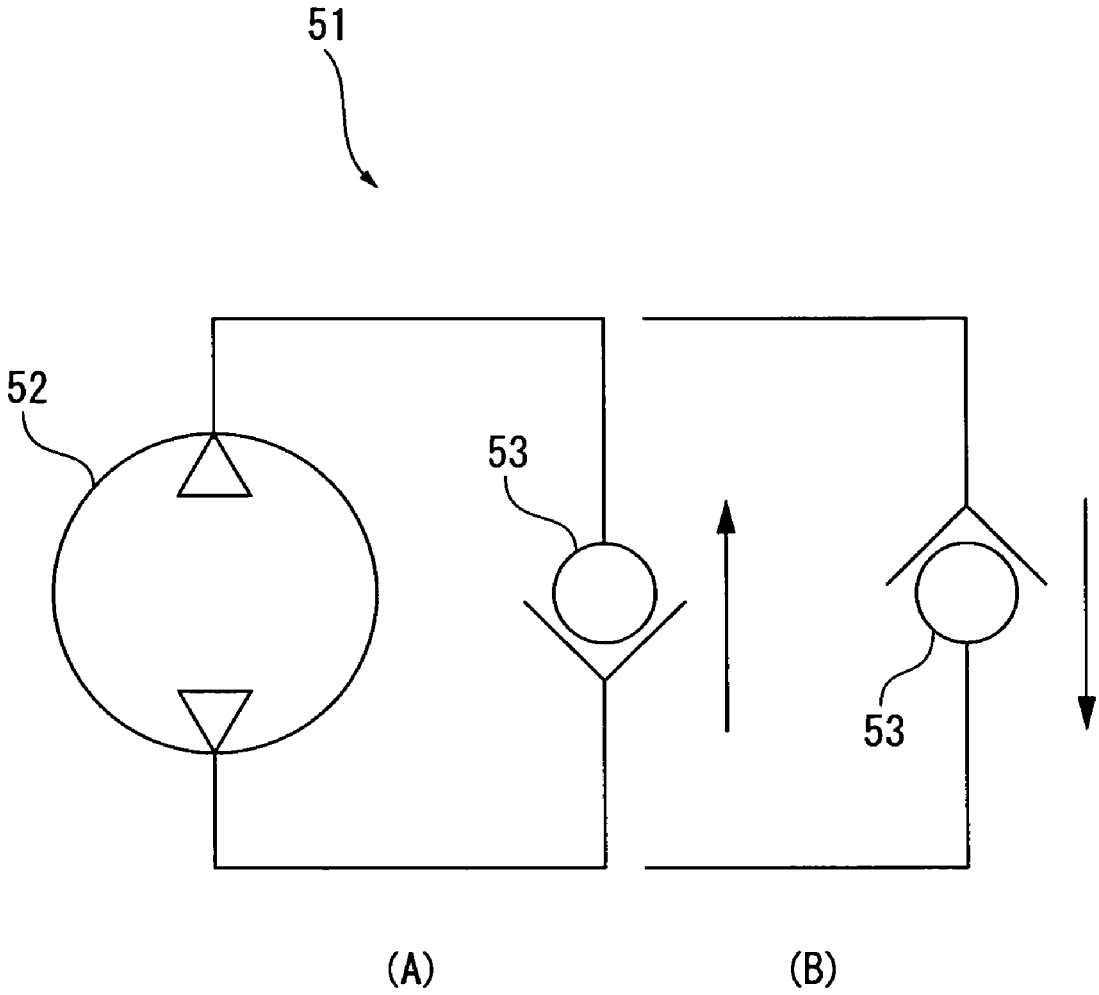
FIG. 16 is a hydraulic circuit diagram showing a restricting device of a second modification of the present invention.

A restricting device 51 of the second modification shown in FIG. 16 is constituted by a closed hydraulic circuit 54 that includes a hydraulic pump 52 connected to an electric motor (not shown and a check valve 53, where an oil-feeding direction of pressure oil at the check valve 53 is switched between (A) and (B) by a switch signal output in accordance with the operated direction of the rotation lever.

Accordingly, in such restricting device 51, even when the rotary body receives the external force in the opposite direction to the operated rotation direction, the check valve 53 operates so as to restrict the rotation direction of the rotary body and prevent the rotary body from rotating in the opposite direction, thereby securely reacting against the external force.

The restricting device is not limited to the restricting devices 41, 51 of the first and second modifications, a brake mechanism for stopping the rotary shaft of the electric motor with frictional force or the like so that the brake mechanism is operated by depressing a foot pedal or the like to prevent the rotary body from rotating in the opposite direction.

Although the best arrangement and method for implementing the present invention has been disclosed above, the present invention is not limited thereto. In other words, while the present invention has been described with reference to the specific embodiments and the drawings thereof, various modifications may be made to the disclosed embodiments by those of ordinary skill in the art without departing from the spirit and scope of the invention.

Therefore, the description that limits the shape and the material is only an example to make the invention easily understood, but is not intended to limit the invention, so that the invention includes the description using a name of component without a part of or all of the limitation on the shape and the material etc.

INDUSTRIAL APPLICABILITY

The present invention is applicable to various construction machines in which a rotary body is rotated by an electric motor.

The invention claimed is:

1. A rotation control device that controls rotation of a rotary body driven by an electric motor based on a command from an operating section, the device comprising:

a rotation position output means which outputs rotation position information of the rotary body;

a reference position storage means which stores an output value of the rotation position output means as a reference position;

a control command generating means which generates and outputs a control command for the electric motor;

a control-system change judging means which judges whether or not to change a control system of the rotation control device based on the output value of the rotation position output means, the reference position stored in the reference position storage means and an operated direction of the operating section; and a control-system changing means which changes the control system of the rotation control device in accordance with the judgment result of the control-system change judging means, wherein the control-system changing means changes the control system so as to increase the control command for the electric motor to be a larger value than that before the change of the control system.

2. The rotation control device according to claim 1, wherein the control system changing means includes:

a reference position update section which updates the reference position stored in the reference position storage means in accordance with the judgment result of the control-system change judging means;

a change command generator which generates a change command for the electric motor based on the output value of the rotation position output means and the reference position stored in the reference position storage means; and a control command output section which selects one with a larger value out of the control command by the control command generating means and the change command by the change command generator and outputs the selected one with the larger value as a control command for the electric motor, and the change of the control system is to maintain the reference position.

3. The rotation control device according to claim 1, wherein the control system changing means includes:

a reference position update section which updates the reference position stored in the reference position storage means in accordance with the judgment result of the control-system change judging means;

a switch-control command generator which generates and outputs a control command for the electric motor using a control law different from that of the control command generating means; and a control law switch section which switches a control law between the control command generating means and the switch-control command generator in accordance with the judgment result of the control-system change judging means, and the change of the control system is to switch the control law from the control command generating means to the switch-control command generator with the control law switch section.

4. The rotation control device according to claim 1, wherein the control system changing means includes:

a reference position update section which updates the reference position stored in the reference position storage means in accordance with the judgment result of the control-system change judging means;

a control gain storage which stores a plurality of control gains for the rotary body; and a control gain changer which changes a control gain to be selected from the control gain storage in accordance with the judgment result of the control-system change judging means, and the change of the control system is to change the control gain with the control gain changer.

5. The rotation control device according to claim 1, wherein the control system changing means includes:

a reference position update section which updates the reference position stored in the reference position storage means in accordance with the judgment result of the control-system change judging means; and a target value changer which changes a control target value of the rotary body which has been set based on an operation input at the operating section in accordance with the output value of the rotation position output means and the reference position stored in the reference position storage means, and the change of the control system is to change the target value with the target value changer.

6. A rotation control method for controlling rotation of a rotary body driven by an electric motor based on a command from an operating section, the method comprising:

outputting rotation position information of the rotary body;

storing an output value of the output rotation position information as a reference position;

generating and outputting a control command for the electric motor;

judging whether or not to change a control system of a rotation control device based on the output value of the rotation position information, the stored reference position and an operated direction of the operating section; and increasing, when judging to change the control system of the rotation control device, the control command for the electric motor to be a value larger than that before the change of the control system.

7. A construction machine, comprising:

a rotary body that is rotated by an electric motor based on a command from an operating section; and a rotation control device which controls rotation of the rotary body;

wherein the rotation control device includes:

a rotation position output means which outputs rotation position information of the rotary body;

a reference position storage means which stores an output value of the rotation position output means as a reference position;

a control command generating means which generates and outputs a control command for the electric motor;

a control-system change judging means which judges whether or not to change a control system of the rotation control device based on the output value of the rotation position output means, the reference position stored in the reference position storage means and an operated direction of the operating section; and a control-system changing means which changes the control system of the rotation control device in accordance with the judgment result of the control-system change judging means, and wherein the control-system changing means changes the control system so as to increase the control command for the electric motor to be a larger value than that before the change of the control system.

8. The construction machine according to claim 7, wherein the control system changing means includes:

a reference position update section which updates the reference position stored in the reference position storage means in accordance with the judgment result of the control-system change judging means;

a change command generator which generates a change command for the electric motor based on the output value of the rotation position output means and the reference position stored in the reference position storage means; and a control command output section which selects one with a larger value out of the control command by the control command generating means and the change command by the change command generator and outputs the selected one with the larger value as a control command for the electric motor, and wherein the change of the control system is to maintain the reference position.

9. The construction machine according to claim 7, wherein the control system changing means includes:

a reference position update section which updates the reference position stored in the reference position storage means in accordance with the judgment result of the control-system change judging means;

a switch-control command generator which generates and outputs a control command for the electric motor using a control law different from that of the control command generating means; and a control law switch section which switches a control law between the control command generating means and the switch-control command generator in accordance with the judgment result of the control-system change judging means, and wherein the change of the control system is to switch the control law from the control command generating means to the switch-control command generator with the control law switch section.

10. The construction machine according to claim 7, wherein the control system changing means includes:

a reference position update section which updates the reference position stored in the reference position storage means in accordance with the judgment result of the control-system change judging means;

a control gain storage which stores a plurality of control gains for the rotary body; and a control gain changer which changes a control gain to be selected from the control gain storage in accordance with the judgment result of the control-system change judging means, and wherein the change of the control system is to change the control gain with the control gain changer.

11. The construction machine according to claim 7, wherein the control system changing means includes:

a reference position update section which updates the reference position stored in the reference position storage means in accordance with the judgment result of the control-system change judging means; and a target value changer which changes a control target value of the rotary body which has been set based on an operation input at the operating section in accordance with the output value of the rotation position output means and the reference position stored in the reference position storage means, and wherein the change of the control system is to change the target value with the target value changer.

* * * * *